US007306214B2

(12) United States Patent
Iida et al.

(10) Patent No.: US 7,306,214 B2
(45) Date of Patent: Dec. 11, 2007

(54) PAPER HANDLING APPARATUS

(75) Inventors: Junichi Iida, Kanagawa (JP); Hiroki Okada, Kanagawa (JP); Junichi Tokita, Kanagawa (JP); Kenji Yamada, Tokyo (JP); Hiromoto Saitoh, Kanagawa (JP); Shuuya Nagasako, Tokyo (JP); Naohiro Kikkawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/896,901

(22) Filed: Jul. 23, 2004

(65) Prior Publication Data

US 2005/0067777 A1 Mar. 31, 2005

(30) Foreign Application Priority Data

Jul. 28, 2003 (JP) ..... 2003-202411
May 12, 2004 (JP) ..... 2004-142129

(51) Int. Cl.
*B65H 37/04* (2006.01)

(52) U.S. Cl. ..... 270/58.11; 270/58.01; 270/58.08

(58) Field of Classification Search ..... 270/58.01, 270/58.08, 58.11
See application file for complete search history.

(56) References Cited

U.S. PATENT DOCUMENTS 5,112,034 A * 5/1992 Uto et al. ..... 270/58.12
5,263,697 A 11/1993 Yamazaki et al.
5,508,798 A 4/1996 Yamada
5,762,328 A 6/1998 Yamada et al.
5,765,824 A * 6/1998 Kawano et al. ..... 270/58.11
6,145,825 A 11/2000 Kunihiro et al.
6,176,480 B1 * 1/2001 Yonenuma et al. ..... 270/58.08
6,199,853 B1 3/2001 Andoh et al.
6,231,045 B1 5/2001 Yamada et al.

(Continued)

FOREIGN PATENT DOCUMENTS

JP 63-272748 11/1988

(Continued)

OTHER PUBLICATIONS

U. S. Appl. No. 10/896,901, filed Jul. 23, 2004, Iida et al.

(Continued)

*Primary Examiner*—Gene O. Crawford
*Assistant Examiner*—Leslie A Nicholson, III
(74) *Attorney, Agent, or Firm*—Oblon, Spivak, McClelland, Maier & Neustadt, P.C.

(57) ABSTRACT

A paper handling apparatus is disclosed, having a first path that guides paper to a processing tray; a second path in which the paper is set aside; and a transportation unit that transports the paper. The paper handling apparatus sets aside a preceding sheet of the paper in the second path, and transports the set-aside preceding sheet of the paper with a following sheet of the paper. The paper handling unit includes: a branching unit that, when the paper is transported in the second direction, leads the paper to the second path; a paper detection unit provided in a more upstream position than the branching unit; and a control unit that determines timing in which the paper is transported in the second direction based on an output of the paper detection unit, and causes the transportation unit to transport the paper to the second path.

12 Claims, 12 Drawing Sheets

U.S. PATENT DOCUMENTS

| | | | |
|---|---|---|---|
| 6,264,191 | B1 | 7/2001 | Suzuki et al. |
| 6,296,247 | B1 | 10/2001 | Tamura et al. |
| 6,322,070 | B2 | 11/2001 | Yamada et al. |
| 6,343,785 | B1 | 2/2002 | Yamada et al. |
| 6,394,448 | B2 | 5/2002 | Suzuki et al. |
| 6,416,052 | B2 | 7/2002 | Yamada et al. |
| 6,494,449 | B2 | 12/2002 | Tamura et al. |
| 6,494,453 | B1 | 12/2002 | Yamada et al. |
| 6,527,269 | B2 | 3/2003 | Yamada et al. |
| 6,549,734 | B2 | 4/2003 | Yamada et al. |
| 6,631,896 | B2 | 10/2003 | Yamada et al. |
| 6,698,744 | B2 | 3/2004 | Yamada et al. |
| 6,783,124 | B2 | 8/2004 | Tamura et al. |
| 2002/0063380 | A1 | 5/2002 | Tamura et al. |
| 2002/0079642 | A1 | 6/2002 | Tamura et al. |
| 2002/0135119 | A1 | 9/2002 | Suzuki et al. |
| 2002/0158405 | A1 | 10/2002 | Nagasako et al. |
| 2003/0006543 | A1 | 1/2003 | Tamura et al. |
| 2003/0057641 | A1 | 3/2003 | Yamada et al. |
| 2003/0151187 | A1 | 8/2003 | Suzuki et al. |
| 2003/0160376 | A1 | 8/2003 | Yamada et al. |
| 2003/0215275 | A1 | 11/2003 | Tamura et al. |
| 2003/0219295 | A1 | 11/2003 | Saitoh et al. |
| 2003/0234487 | A1 | 12/2003 | Tamura et al. |
| 2004/0051238 | A1 | 3/2004 | Yamada et al. |
| 2004/0070133 | A1 | 4/2004 | Yamada et al. |
| 2004/0104525 | A1 | 6/2004 | Suzuki et al. |
| 2005/0067777 | A1 | 3/2005 | Iida et al. |

FOREIGN PATENT DOCUMENTS

| | | |
|---|---|---|
| JP | 1-127556 | 5/1989 |
| JP | 5-147372 | 6/1993 |
| JP | 5-238622 | 9/1993 |
| JP | 5-254704 | 10/1993 |
| JP | 6-16323 | 1/1994 |
| JP | 6-87554 | 3/1994 |
| JP | 8-301508 | 11/1996 |
| JP | 9-48545 | 2/1997 |
| JP | 9-235069 | 9/1997 |

OTHER PUBLICATIONS

U.S. Appl. No. 11/223,052, filed Sep. 12, 2005, Suzuki et al.
U.S. Appl. No. 11/267,403, filed Nov. 7, 2005, Tokita et al.
U.S. Appl. No. 11/273,301, filed Nov. 15, 2005, Iida et al.
U.S. Appl. No. 11/254,868, filed Oct. 21, 2005, Suzuki et al.
U.S. Appl. No. 11/519,039, filed Sep. 12, 2006, Yamada et al.

* cited by examiner

PAPER BACKEND REFERENCE COUNTER

PAPER FRONT-END REFERENCE COUNTER

REVERSE DISTANCE COUNTER

PAPER HANDLING APPARATUS

BACKGROUND OF THE INVENTION

1. Field of the Invention

The present invention generally relates to a paper handling apparatus, and more particularly, to a paper handling apparatus coupled to an image forming apparatus for sorting, stapling, and stacking papers discharged from the image forming apparatus.

2. Description of the Related Art

Many kinds of paper handling apparatuses coupled to an image forming apparatus for sorting, stapling, and stacking papers discharged from the image forming apparatus are known in the art. Japanese Laid-Open Patent Applications No. 8-301508 and 9-235069, for example, disclose a paper handling apparatus that can buffer the paper so that the image forming apparatus does not need to wait for the paper handling apparatus to complete the handling of paper.

The paper handling apparatus needs to control the number of buffered sheets, for example, since the printing speed, the number of copies, and processing mode of the image forming apparatus affect the buffering operation. For those purposes, the paper handling apparatus is conventionally provided with many dedicated paper detection sensors, and requires a complicatedly shaped guide plate to hold the paper detections sensors.

For example, when the paper needs to be stapled, the paper is temporarily stored on a processing tray, and is sent to the next stage in response to a signal from a paper detection sensor. If only a few pages are to be stapled, however, the paper detection sensor fails to detect the paper in time. In such a case, excessive paper may be stacked on the paper to be stapled. As described above, the number of sheets to be buffered needs to be controlled based on the speed of printing, the number of sheets, and the processing mode of the image forming apparatus. In addition, as the speed of printing of the image forming apparatus increases, the paper handling apparatus needs to handle the paper quickly enough so as not to keep the image forming apparatus waiting.

In addition, when a preceding sheet of paper that is set aside is re-transported, the deviation between the preceding sheet and a following sheet affects the accuracy of alignment performed in the processing tray. The deviation is preferably fixed in order to maintain the accuracy of alignment at a high level. When the paper transported at high speed is stopped in a short time, the paper may not stop at a desired position.

SUMMARY OF THE INVENTION

Accordingly, it is a general object of the present invention to provide a novel and useful paper handling apparatus in which at least one of the above problems is eliminated.

Another and more specific object of the present invention is to provide a paper handling apparatus that buffers the paper discharged from the image forming apparatus sheet by sheet and outputs buffered multiple sheets of paper in response to a signal from a single paper detection sensor provided therein.

To achieve at least one of the above objects, a paper handling apparatus according to the present invention, comprises:

a first path that guides paper to a processing tray;

a second path in which the paper is set aside, said second path branching from said first path, a transportation unit that transports the paper in one of a first direction toward the processing tray and a second direction opposite to the first direction;

a branching unit that, when the paper is transported in the second direction, leads the paper to the second path;

a paper detection unit provided in a more upstream position than the branching unit; and a control unit that determines timing in which the paper is transported in the second direction based on an output of the paper detection unit, and causes the transportation unit to transport the paper to the second path, wherein the paper handling apparatus sets aside a preceding sheet of the paper in the second path, and transports the set-aside preceding sheet of the paper with a following sheet of the paper.

Accordingly, the preceding sheet of paper can be set aside in the second path, and re-transported together with the following sheet superposed on the preceding sheet.

Other objects, features, and advantages of the present invention will become more apparent from the following detailed description when read in conjunction with the accompanying drawings.

DETAILED DESCRIPTION OF THE PREFERRED EMBODIMENTS

The preferred embodiments of the present invention are described in detail below with reference to the drawings.

1st Embodiment

<Entire Configuration>

Figure 1:
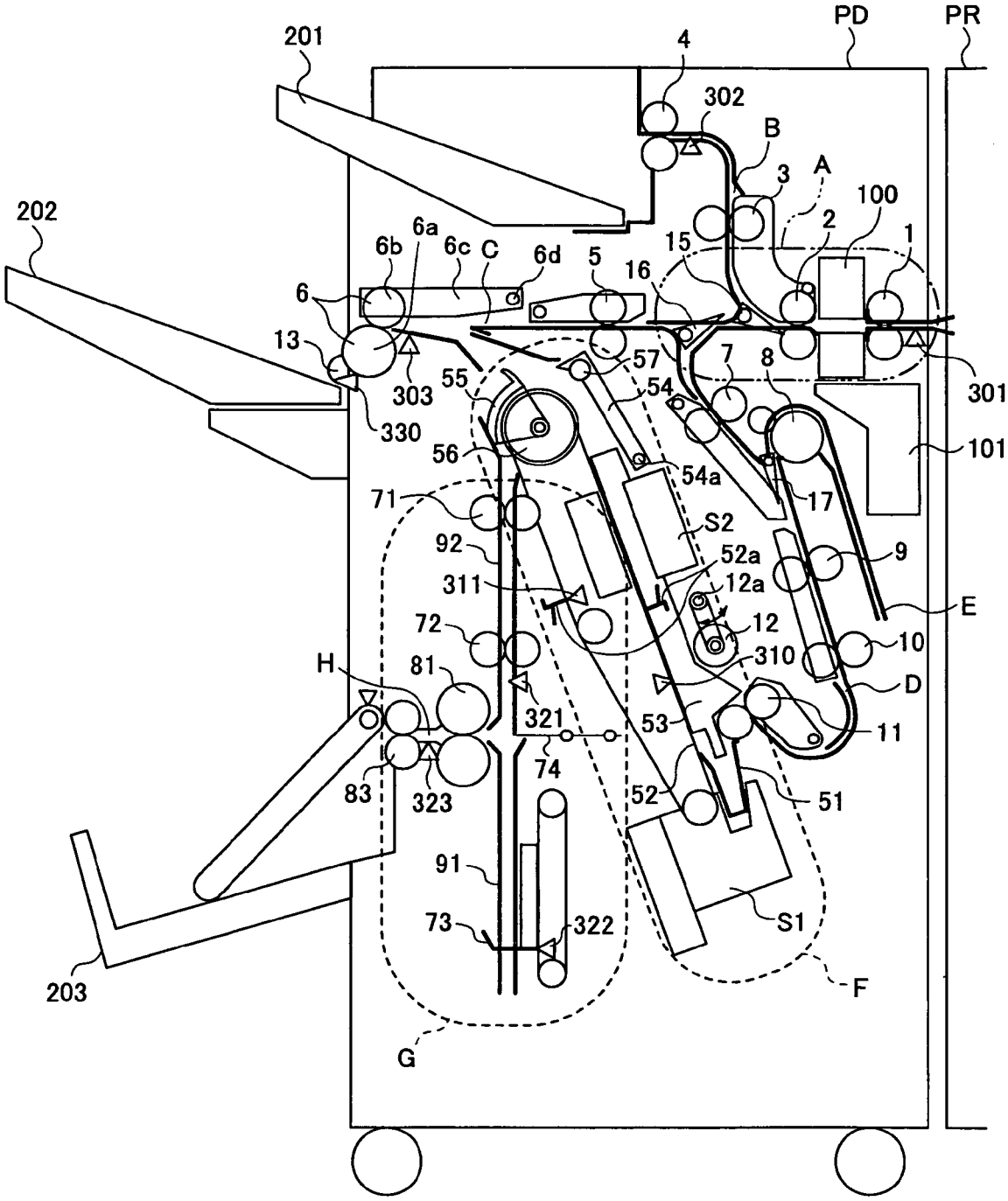
FIG. 1 is a cross section showing an image forming system including a paper handling apparatus coupled to an image forming apparatus, according to an embodiment.

FIG. 1 is a cross section of an image forming system including a paper handling apparatus according to an embodiment and an image forming apparatus. As shown in FIG. 1, the entire cross section of the paper handling apparatus is shown, but only a portion of the image forming apparatus is shown.

As shown in FIG. 1, the paper handling apparatus PD is provided at the side of the image forming apparatus PR. The paper discharged from the image forming apparatus PR is guided to the paper handling apparatus PD. Each sheet of paper is transported through a path A having a post-processing unit. The post-processing unit includes, but is not limited to, a punch unit 100, for example, that punches the sheet of paper. After passing through the path A, the sheet of paper is directed to either a path B, a path C, or a path D by branching nails 15 and 16. The sheet of paper directed to the path B is directly discharged onto a upper tray 201 via transportation roller pairs (hereinafter referred to as "transportation rollers") 2, 3, and 4. The sheet of paper directed to the path C is discharged onto a shift tray 202 via transportation rollers 2, 5, and 6. The sheet of paper directed to the path D is transported downward via transportation rollers 7, 8, 9, and 10, but is redirected upward between the transportation roller 10 and a staple discharging roller 11, and then stacked on a processing tray (which hereinafter may be referred to as "staple processing tray") F. The staple processing tray F is inclined so that each sheet of paper is stacked thereon with its downstream side of transportation located upward. In the processing tray F, the paper is buffered, aligned, and stapled, for example. The staple processing tray F is inclined at a minimum angle at which the staple processing tray F does not interfere with a center folding plate 74 and its driving mechanisms, and a single sided stapler S1.

As described above, the paper is guided to the staple processing tray F via the paths A and D, and is aligned and stapled. Then, the paper is transported to either the path C or a path H. When the paper is transported to the path C, the paper is guided by a branching guide plate 54 and a movable guide 55, and discharged onto the shift tray 202. When the paper is transported to the path H, the paper may be further processed in a processing tray G, and then, is discharged onto a lower tray 203. The processing tray G (which hereinafter may be referred to as a folding processing tray) may, for example, fold the paper.

A branching nail 17 is provided in the path D, and is kept in a state as shown in FIG. 1 by a low load spring (not shown). When the rear end of a sheet of paper passes through the branching nail 17, the sheet of paper can be guided into a pre-stacking path (paper storing unit) E by reversing at least the staple discharging roller 11 among the transportation rollers 9, 10 and the staple discharging roller 11, for example. According to the above arrangements, multiple sheets of paper are buffered in the pre-stacking path E, and the stacked multiple sheets can be transported together.

The path A is located at an upstream side of the paths B, C, and D. The following elements are provided along the path A in that order: an entrance sensor 301, an entrance roller 1, the punch unit 100, a punch trash hopper 101, the transportation roller 2, the branching nail 15, and the branching nail 16. The branching nails 15 and 16 are kept in a state as shown in FIG. 1 by springs (not shown). When a solenoid (not shown) corresponding to the branching nail 15 is turned on, the branching nail 15 turns upward. Similarly, when a solenoid (not shown) corresponding to the branching nail 16 is turned on, the branching nail 16 turns downward. The operation of the branching nails 15 and 16 causes sheets of paper to be directed to one of the paths B, C, and D.

When the solenoid (not shown) corresponding to the branching nail 15 is turned off, the branching nail 15 is kept as shown in FIG. 1, and as a result, the paper is guided to the path B. When the solenoids (not shown) corresponding to the branching nails 15 and 16 are turned on, the branching nail 15 is turned upward, and the branching nail 16 is turned downward, and as a result, the paper is guided to the path C. When the solenoid corresponding to the branching nail 16 is turned off, and the solenoid corresponding to the branching nail 15 is turned on, the paper is guided to the path D.

The paper handling apparatus according to the present embodiment has the following functions: punching (by the punch unit 100), aligning and corner stapling (by a jogger fence 53 and the corner stapler S1), aligning and center stapling (by the jogger fence 53 and a center stapler S2), sorting (by shift tray 202), and center folding (by the folding plate 74 and folding roller 81), for example.

The image forming apparatus PR included in the image forming system according to an embodiment is an image forming apparatus using electrophotography that receives input image data, forms a latent image on a photosensitive drum, for example, based on the received input image data, develops the formed latent image with toner, and transfers the developed toner image to paper, for example. Since the image forming apparatus PR is known in the art, its description is omitted.

According to another embodiment, the image forming apparatus PR may be a printer such as an ink jet printer and a laser printer, or any system including such a printer.

<Stapling Processing Tray>

The paper guided to the processing tray F by the staple discharge roller 11 is stacked on the face of the processing tray F in which the paper is aligned and stapled. The paper is aligned in the vertical direction (the direction in which the paper is transported) by a tapping roller 12, and is aligned in the horizontal direction (the direction perpendicular to the direction in which the paper is transported) by the jogger fence 53. Then, when the last sheet of the paper that is printed as a job is stacked on the processing tray F, the corner stapler S1 is activated to staple the paper printed as the job. Then, the paper printed as the job is transported to a shift discharging roller 6 by a discharging belt 52, and discharged onto the shift tray 202 set at a receiving position. The discharged paper is put close to the lower end of the shift tray 202 by a roller 13.

A discharging belt home position (HP) sensor 311 is configured to detect the home position of a discharging nail 52*a*. The discharging belt HP sensor 311 is turned on and off by the discharging nail 52*a* provided on the discharging belt 52. Two discharging nails 52*a* are provided on the outer surface of the discharging belt 52 at opposite positions. The discharging nails 52*a* transport the paper batch stored on the processing tray F alternately. If necessary, the discharging belt 52 may be rotated in the opposite direction so that the head (the end in the direction in which the paper is transported) of the paper stored in the processing tray F is aligned by the back of the discharging nail 52*a* opposite the discharging nail 52*a* that is going to discharge the paper.

The discharging belt 52 is driven by a discharging motor (not shown). The discharging belt 52 and a driving pulley are positioned on a driving shaft of the motor at the center in the directions of the width of the paper. A discharging roller 56 is provided at an opposite position. The rotational speed of the discharging roller 56 at its perimeter (linear velocity) is set greater than that of the discharging belt 52. The tapping roller 12 is swung by a tapping SOL (not shown) around a fulcrum 12*a*. The tapping roller 12 taps the paper stored in the staple processing tray F at regular intervals, and pushes the paper toward a back-end fence 51. The tapping roller 12 rotates in the counter-clock wise direction. The jogger fence 53 is driven via a timing belt by a jogger motor (not shown) that can rotate forward and reverse, and moves back and forth in the paper width directions.

The corner stapler S1 is driven via a timing belt by a stapler moving motor (not shown) that can rotate bidirectionally, and is moved to a corner position of the paper in the paper width directions so that the stapler S1 staples the paper at the corner. A stapler moving HP sensor is provided at an end of the moving range of the stapler S1. The stapler moving HP sensor detects the home position of the corner stapler S1. The position at which the paper is stapled is controlled based on the moving distance of the corner stapler S1 from the home position.

Two center staplers S2 are provided at positions symmetric to the alignment center in the paper width directions. The center staplers S2 are positioned so that the distance between the back-end fence 51 and the stapling position of the center stapler S2 becomes one half or more of the maximum length of the paper in its transportation direction that the center staple S2 can staple. The center stapler S2 includes a needle unit, and is divided into a stitcher (driver) unit that stitches the paper with needles and a clincher unit that clinches the needles. The stitcher unit S21 (not shown) is positioned at the transportation path D side of the processing tray F. The reference numeral 310 in FIG. 1 indicates a paper sensor that determines whether a sheet of paper is stored in the staple processing tray F.

The batch of paper that is center-stapled in the staple processing tray F is folded at the center. The folding is performed in a center folding processing tray G. The stapled batch of paper needs to be transported to the center folding processing tray G. According to the present embodiment, a redirecting mechanism is provided at a downstream side of the staple processing tray F. The redirecting mechanism transports the batch of paper to the center folding processing tray G.

The redirecting mechanism includes a branching guide plate 54 and a movable guide 55. The branching guide plate 54 is provided swingably around a fulcrum 54*a* in the vertical directions. A rotatable pressure roller 57 is provided at the downstream side of the branching guide plate 54. The rotatable pressure roller 57 is forced by a spring toward the discharging roller 56. The branching guide plate 54 is driven by a cam. The movable guide plate 55 is driven by a link.

<Center Folding Processing Tray>

The center folding processing tray G includes a lower guide plate 91 and a upper guide plate 92 positioned in the vertical directions. A folding plate 74 is provided at a folding position. The folding plate 74 moves back and forth in directions perpendicular to the guide plates 91 and 92. The folding position depends on paper size. A movable back-end fence 73 is provided on the lower guide plate 91. The movable back-end fence 73 holds the paper so that the center of the paper opposes the folding plate 74. Transportation rollers 71 and 72 transport the batch of paper in the guide plates 91 and 92. The batch of paper is center folded by the folding plate 74 and a folding roller 81. The folded batch of paper passes through the transportation path H, and is discharged onto the lower tray 203 by a discharging roller 83.

Figure 2:
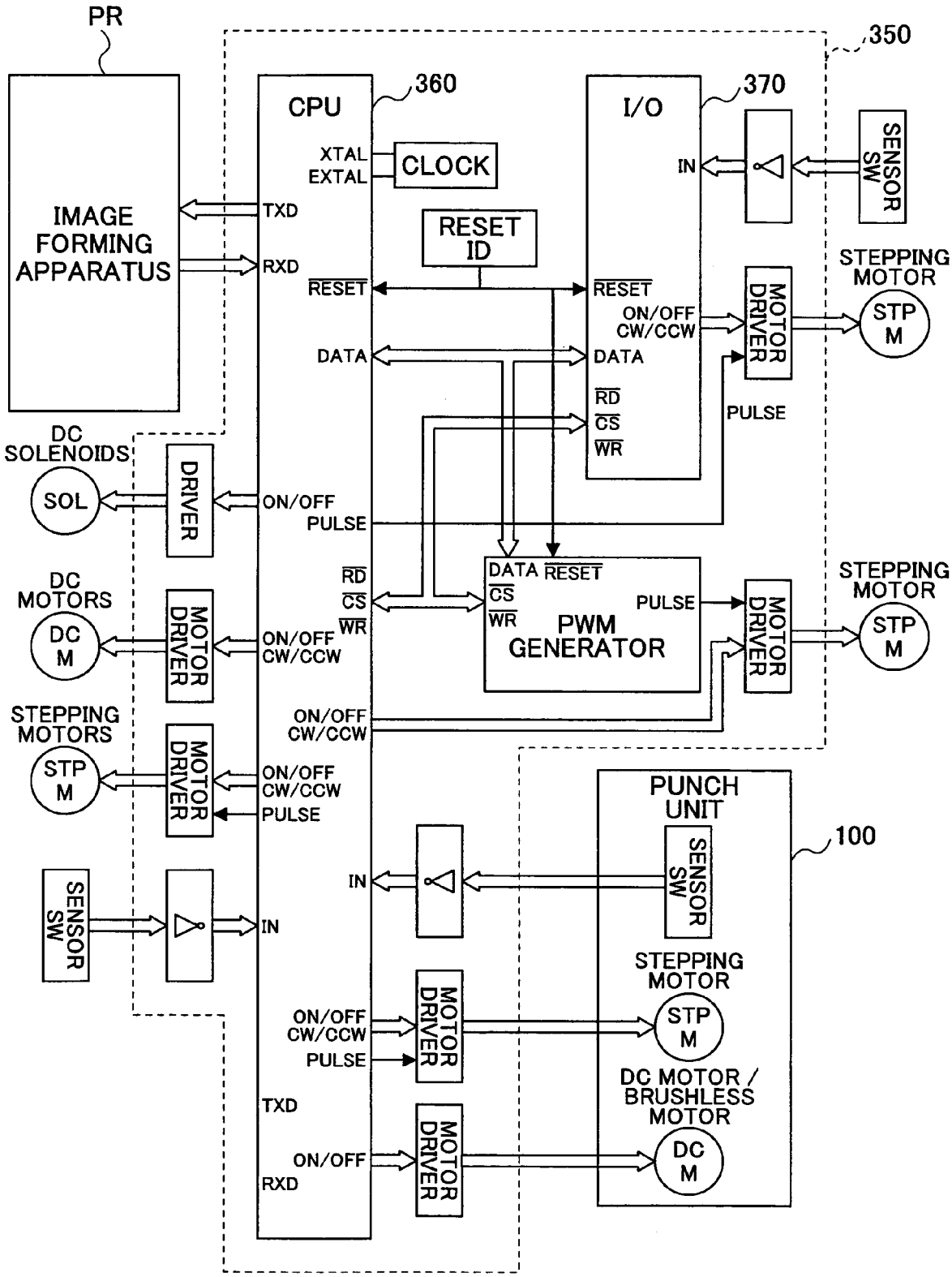
FIG. 2 is a block diagram showing the configuration of the image forming system according to an embodiment.

As shown in FIG. 2, a controlling unit 350 is a microcomputer including a CPU 360 and an I/O interface 370, for example. The CPU 360 receives via the I/O interface 370 the signals from switches provided on the control panel of the image forming apparatus PR and the signals from the following sensors: an entrance sensor 301, a upper discharge sensor 302, a shift discharge sensor 303, the paper sensor 310, the discharging belt home position sensor 311, a batch arrival sensor 321, a movable back-end fence home position sensor 322, a folding position passing sensor 323, and a paper face detection sensor 330, for example.

The CPU 360 controls the following elements based on input signals: a tray elevating motor for elevating the shift tray 202, a discharging guide plate opening motor for opening and closing an opening guide plate, a shift motor for moving the shift tray 202, a tapping roller motor for driving the tapping roller 12, solenoids such as the tapping SOL, transportation motors for driving the transportation rollers, discharging motors for driving the discharging rollers, the discharging motor for driving the discharging belt 52, the stapler moving motor for moving the corner stapler S1, a slanting motor for slanting the corner stapler S1, and the jogger motor for moving the jogger fence 53, for example. A motor staple discharging roller is driven by a stapler transporting motor (not shown). The pulse signal output by the staple transporting motor is input to the CPU 360 and counted. The tapping SOL and the jogger motor are controlled based on the count. The CPU 360 controls the punch unit 100 by controlling a clutch and a motor.

The CPU 360 controls the paper handling apparatus PD by executing computer programs stored in ROM (not shown) using RAM (not shown) as a working area. The computer programs may be downloaded to, or updated in a recording medium of a hard disk drive (not shown), for example, from a server via a network or from a recording medium such as a CD-ROM and a SD memory card via a recording medium driving apparatus.

<Operations>

Figure 3:
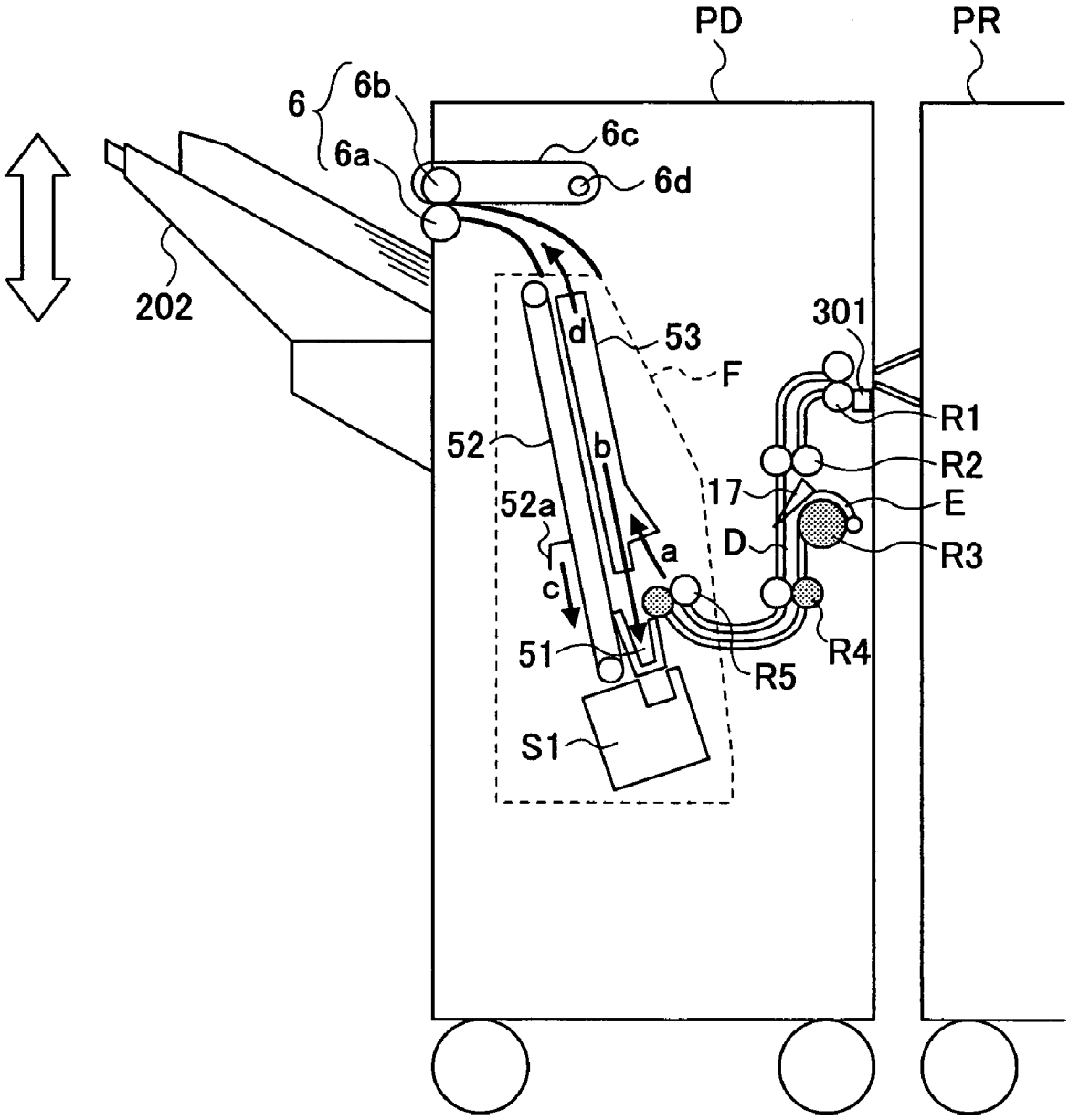
FIG. 3 is a schematic diagram for explaining the operation of a paper handling apparatus according to an embodiment.

FIG. 3 is a schematic diagram for explaining the operations of the paper handling apparatus according to an embodiment. FIGS. 4 through 7 are schematic diagrams for explaining a pre-stacking operation, according to an embodiment, in which the paper is stored in a transportation path E (referred to as a pre-stacking path) and then, is output.

The punch unit 100 of FIG. 1 is omitted in FIG. 3. The pre-stacking operation and the path through which the paper is discharged from the staple processing tray F to the shift tray 202 are shown in FIG. 3. The transportation rollers R1 and R2 at the upstream side of the branching nail 17 are driven by a first transportation motor (not shown). The transportation rollers R3, R4, and R5 at the downstream side of the branching nail 17 are driven by a second transportation motor (not shown). In FIG. 3, two transportation rollers R1 and R2 are shown as rollers at the upstream side of the branching nail 17, and three transportation rollers R3, R4, and R5 are shown as rollers at the downstream side of the branching nail 17. Similarly, in FIG. 1, three transportation rollers 1, 2, and 7 are shown as rollers at the upstream side of the branching nail 17, and four transportation rollers 8, 9, 10, and 11 are shown as rollers at the downstream side of the branching nail 17. The transportation rollers 1, 2, and 7 provided at the upstream side of the branching nail 17 are driven by a motor, and the transportation rollers 8, 9, 10, and 11 provided at the downstream side of the branching nail 17 are driven by another motor independently. The difference in the configuration of the transportation motors between FIG. 1 and FIG. 3 is not essential to the embodiment. Accordingly, the description will be given with reference to FIG. 3. As will be appreciated, even is the transportation roller R3 (corresponding to the transportation roller 8 in FIG. 1) is removed, the configuration of the transportation rollers can operate as long as the transportation rollers are positioned close enough to hand over the paper.

The transportation rollers R3, R4, and R5 can transport the paper that has been transported from the path A to the path D to the reverse direction. That is, the paper is transported toward the entrance from the image forming apparatus PR. This motion of the paper may be referred to "reverse stream". The second transportation motor M2 (not shown) is reversely rotated so that the paper is moved in the reverse stream. The second transportation motor M2 is not shown in FIG. 3, but is referred to with the reference symbol M2 since it will be referred to in a flowchart to be explained below. The first transportation motor M1 is also not shown in FIG. 3, but is referred to with the reference symbol M1 since it will be referred to in the flowchart to be explained below. According to another embodiment, a clutch may be used to reversely rotate the transportation roller R3, R4, and R5, instead of reversely rotating the transportation motor M2.

The branching nail 17 is provided in the path D. When the paper is moved in the reverse stream, the branching nail 17 guides the paper to the pre-stacking path E. Multiple sheets of paper are stacked in the pre-stacking path E, and the stacked sheets of paper are discharged into the staple processing tray F. The number of sheets of paper to be stacked in the pre-stacking path E is controlled by information (control signal, for example) provided by the image forming apparatus PR.

The paper output by the image forming apparatus PR is input to the paper handling apparatus PD. The paper is transported by the transportation rollers R1 and R2 driven by the first transportation motor M1 (not shown). The paper pushes the branching nail 17 counterclockwise and forms the path D. The paper passes through the path D, and is further transported by the transportation rollers R4 and R5 to the staple processing tray F (the direction indicated by an arrow "a").

When transported to the staple processing tray F, the paper falls down in the direction indicated by an arrow "b". The paper is aligned by the back-end fence 51 in the transportation direction. When the estimated time required for aligning the paper in the transportation direction has passed after the back end of the paper is detected by the entrance sensor 301, the paper is aligned by the jogger fence 53 in the direction perpendicular to the transportation direction. The back-end fence 51 and the jogger fence 53 repeat the same action to align the paper sheet by sheet.

After being aligned, the paper (the batch of paper) is stapled by the stapler S1. The discharging belt 52 in the staple processing tray F rotates in a direction indicated by an arrow "c". The discharging nail 52*a* fixed on the discharging belt 52 pushes the lower end of the batch of paper. As a result, the paper is discharged from the staple processing tray F in a direction indicated by an arrow "d". The batch of paper is discharged to the shift tray 202 by a discharging roller 6*a* and a passive roller 6*b*, and is stacked on the shift tray 202.

The shift tray 202 is provided with a mechanism that elevates the shift tray 202 depending on the number of batches to be stacked. The passive roller 6*b* is provided on a transportation guide plate 6*c* in a rotatable manner. The transportation guide plate 6*c* is supported swingably around a fulcrum 6*d* as the center so that the transportation guide plate 6*c* can affect the same transportation force even if the thickness of the batch of paper changes. The transportation guide plate 6*c* presses the batch of paper toward the discharging roller 6a using its own weight. The operation in the case of one batch of paper being discharged has thus been described.

According to the present embodiment, the branching nail 17 is activated to open the pre-stacking path E, and the paper can be guided into the pre-stacking path E by reversely rotating the transportation roller R3, R4, and R5. The detection by the entrance sensor 301 of the front end of the paper input from the image forming apparatus PR is used as a reference to determined when the paper stored in the pre-stacking path E is transported again. The detection by the entrance sensor 301 of the back end of the paper is used as a reference to determined when the paper is reversed into the pre-stacking path E.

Figure 4:
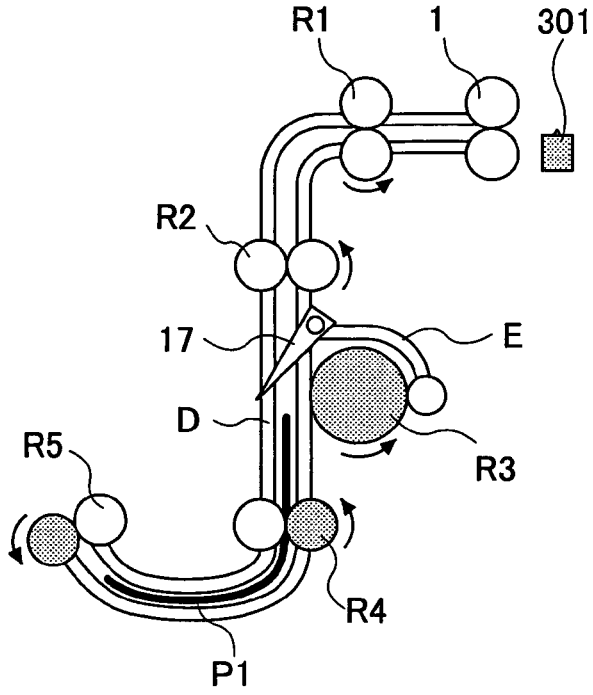
FIG. 4 is an enlarged schematic diagram for explaining the operation of the paper handling apparatus according to an embodiment, in which a preceding sheet of paper has been transported to a path D.
Figure 5:
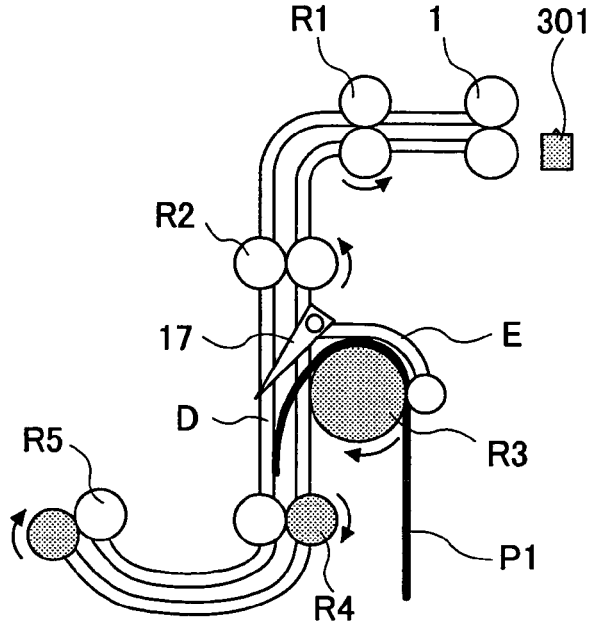
FIG. 5 is another enlarged schematic diagram for explaining the operation of the paper handling apparatus according to an embodiment, in which the preceding sheet of paper that has been transported to the path D is reversely transported to a pre-stack path.

A preceding sheet of paper sent from the image forming apparatus PR is temporarily stored in the pre-stacking path E, and a following sheet of paper is stacked on the preceding sheet of paper, and then, transported to the staple processing tray F. In this case, as shown in FIG. 4, the preceding sheet of paper P1 is transported by the transportation rollers R1 and R2 rotating forward. In the following description, the direction in which the paper is transported toward the staple processing tray F is referred to as the forward direction, and the direction opposite to the forward direction is referred to as the reverse direction. The sheet P1 presses the back of the branching nail 17 as described above, and moves to the downstream direction through the path D. When the sheet P1 is transported for a predetermined number of pulses (to be described below) after the back-end of the sheet P1 is detected by the entrance sensor 301, the transportation rollers R3, R4, and R5 rotate reversely. As a result, the sheet P1 is reversed, and transported in the opposite direction. When the sheet P1 is reversed, the branching nail 17 closes the path D as shown in FIGS. 4 and 5, and opens the pre-stacking path E. As a result, the back-end of the sheet P1 transported in the reverse direction is guided into the pre-stacking path E as shown in FIG. 5. The transportation rollers R3, R4, and R5 stop, leaving a predetermined portion of the front end of the sheet P1 in the path D. The sheet P1 is put aside.

Figure 6:
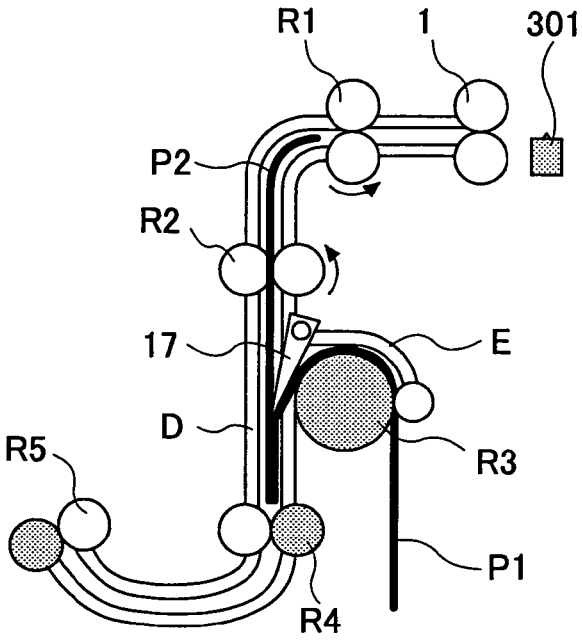
FIG. 6 is yet another enlarged schematic diagram for explaining the operation of the paper handling apparatus according to an embodiment, in which a following sheet of paper has been transported to the path D.
Figure 7:
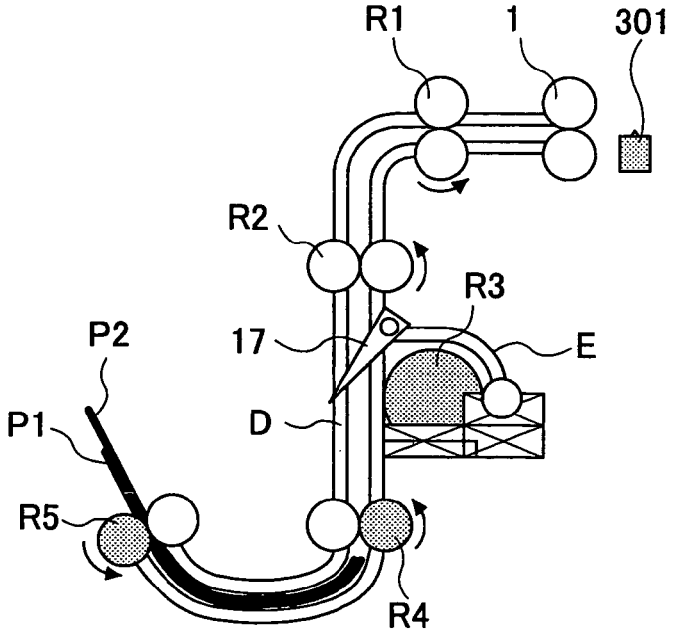
FIG. 7 is yet another enlarged schematic diagram for explaining the operation of the paper handling apparatus according to an embodiment, in which the following sheet of paper is stacked on the preceding sheet of paper, and the batch of paper is output from the pre-stacking path.

A following sheet of paper P2 is sent from the image forming apparatus PR by the transportation rollers R1 and R2 rotating in the forward rotative direction. As shown in FIG. 6, when the front end of the following sheet P2 precedes the front end of the preceding sheet P1 by a predetermined length, the transportation rollers R3, R4, and R5 start rotating in the forward rotative direction. If only the two sheets of paper P1 and P2 need to be transported, the sheets of paper are discharged to the staple processing tray F. Similarly, if three or more sheets of paper need to be transported, two preceding sheets of paper that are overlapping each other are sent to the pre-stacking path E by rotating the transportation rollers R3, R4, and R5 in the reverse rotative direction at the same timing as shown in FIG. 5. When a third sheet of paper is sent from the image forming apparatus PR, the third sheet and the two preceding sheets overlap, and are transported together to the staple processing tray F.

As described above, the sheets of paper are overlapped with each other using the pre-stacking path E, and are sent together. This operation is performed when the paper printed as a first copy is completed and the paper printed as a second copy starts. While the paper printed as the first copy is stapled in the staple processing tray E, the first sheet of paper belonging to the paper printed as the second copy needs to be delayed.

The image forming apparatus PR may wait until the staple processing in the staple processing tray F is completed. In this case, however, the efficiency of the image forming apparatus PR is degraded. Hence, it is preferable that the image forming apparatus PR be able to print the last sheet of paper belonging to the paper printed as the first copy and the first sheet of paper belonging to the paper printed as the second copy in the manner in which the image forming apparatus PR prints sheets of paper printed as the same copy. The image forming apparatus PR outputs the last sheet belonging to the paper printed as the first copy and the first sheet belonging to the paper printed as the second copy continuously in the same manner. The image forming apparatus PR sends signals to the paper handling apparatus PD. The signals include information such as the number of sheets of paper to be transported, the speed of transportation, and a processing mode. Receiving the signals from the image forming apparatus PR, the paper handling apparatus PD determines the number of sheets of paper to be set aside in the pre-stacking path E, the timing in which the transportation rollers R1, R2, R3, R4, and R5 are accelerated, their linear speed, the timing in which the transportation rollers R1, R2, R3, R4, and R5 are reversed, and their reversed linear speed.

The operation described above is summarized as below. The transportation rollers R1 and R2 rotate in the rotative direction indicated by the arrow (forward rotative direction), and the first sheet of the second copy is transported. The first sheet P1 is accelerated based on the detection by the entrance sensor 301. The timing at which the first sheet P1 is reversed is determined based on a pulse count or time period measured by a timer in response to the detection of the back end of the first sheet P1 by the entrance sensor 301. If it is determined, based on the signals from the image forming apparatus PR, that the sheet P1 needs to be reversed, the transportation rollers R3, R4, and R5 rotate in the reverse rotative direction. The sheet P1 is transported in the opposite direction through the branching nail 17, and is decelerated and stopped at a predetermined timing. Then, the second paper P2 is transported in the forward direction by the transportation rollers R1 and R2. The transportation rollers R3, R4, and R5 rotate in the forward rotative direction, and the first sheet P1 and the second sheet P2 are overlapped and transported together. If the number of sheets of paper set aside is less than the number of sheets of paper indicated in the signal from the image forming apparatus PR, the same operation as the first sheet is repeated until the number of sheets of paper actually set aside reaches the number indicated in the signal from the image forming apparatus PR. Then the paper set aside is discharged in the staple processing tray F.

Figure 8:
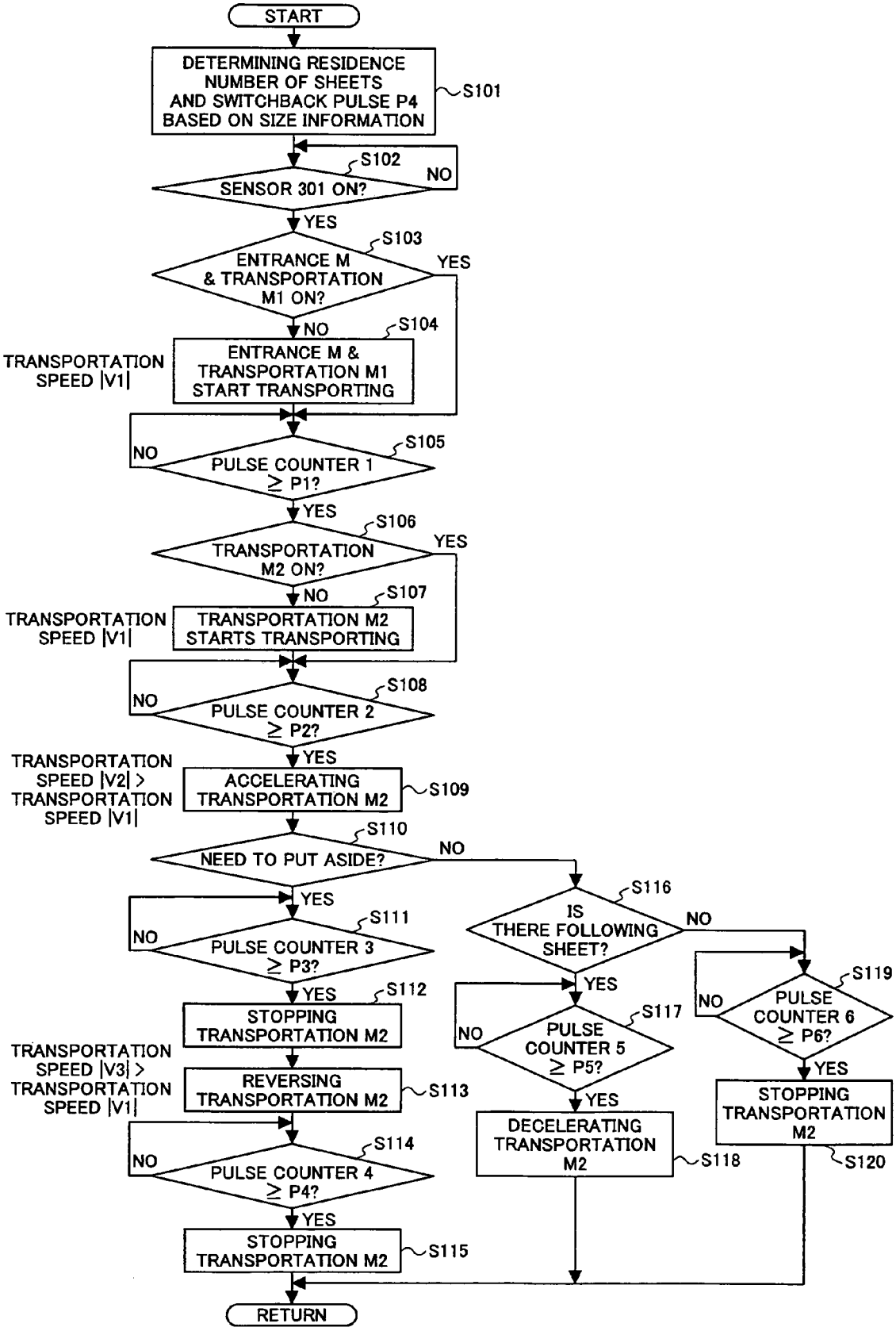
FIG. 8 is a flowchart for explaining the operation of the paper handling apparatus according to an embodiment.

FIG. 8 is a flowchart showing processing of the CPU that performs the operation described above. When a start key (not shown) of the image forming apparatus PR is pressed, the paper handling apparatus PD receives information indicating the processing mode of paper and transportation speed from the image forming apparatus PR. There are two processing modes, that is, staple mode and shift mode. The paper handling apparatus according to the present embodiment is configured so that the image forming apparatus does not need to change printing speed in the staple mode.

The pre-stacking operation is not required for the first copy. When the sheets of paper printed as the first copy are completely transported to the staple processing tray F, the paper handling apparatus PD receives information indicating paper size and the number of sheets from the image forming apparatus PR (step S101). In this step S101, the number of sheets to be set aside in the pre-stacking path E and the number of pulses (switch back pulse P4) until the second transportation motor M2 is reversed are determined based on the size information received from the image forming apparatus PR. Since the first and second transportation motors M1 and M2 are configured by pulse motors, for example, their rotation (that is, the distance the paper is transported) is controllable with the number of pulses.

When the entrance sensor 301 detects the front end of the paper and outputs an ON signal (YES in step S102), a determination is made of whether the entrance motor M that activates the transportation roller 1 and the first transportation motor M1 that activates the transportation roller R1 and R2 (corresponding to the transportation rollers 2 and 7 in FIG. 1) are in an ON state, that is, the transportation motors M and M1 are activated (step S102).

If the motors M and M1 are in an OFF state (NO in step S103), the motors M and M1 are turned ON, and the transportation rollers 1, R1, and R2 start transporting the paper at a transportation speed V1 (step S 104). The rotation of the first transportation motor M1 is counted by a pulse counter 1 (step S 105). The pulse counter 1 counts driving pulses output to the first transportation motor M1 (stepping motor) by the CPU 360 provided in a control unit 350 shown in FIG. 2. The pulse counters 2, 3, 5, and 6 (described below) operate in the same maimer. When the entrance sensor 301 is turned on (i.e. detects the front end of the paper) and the first transportation motor M1 is turned on, the pulse counter 1 starts counting (see FIG. 10, steps S301-S303). If the entrance transportation motor M and the first transportation motor M1 are in the ON state in step S103, step S104 is skipped, and the count value of the pulse counter 1 is checked in step S105.

Figure 9:
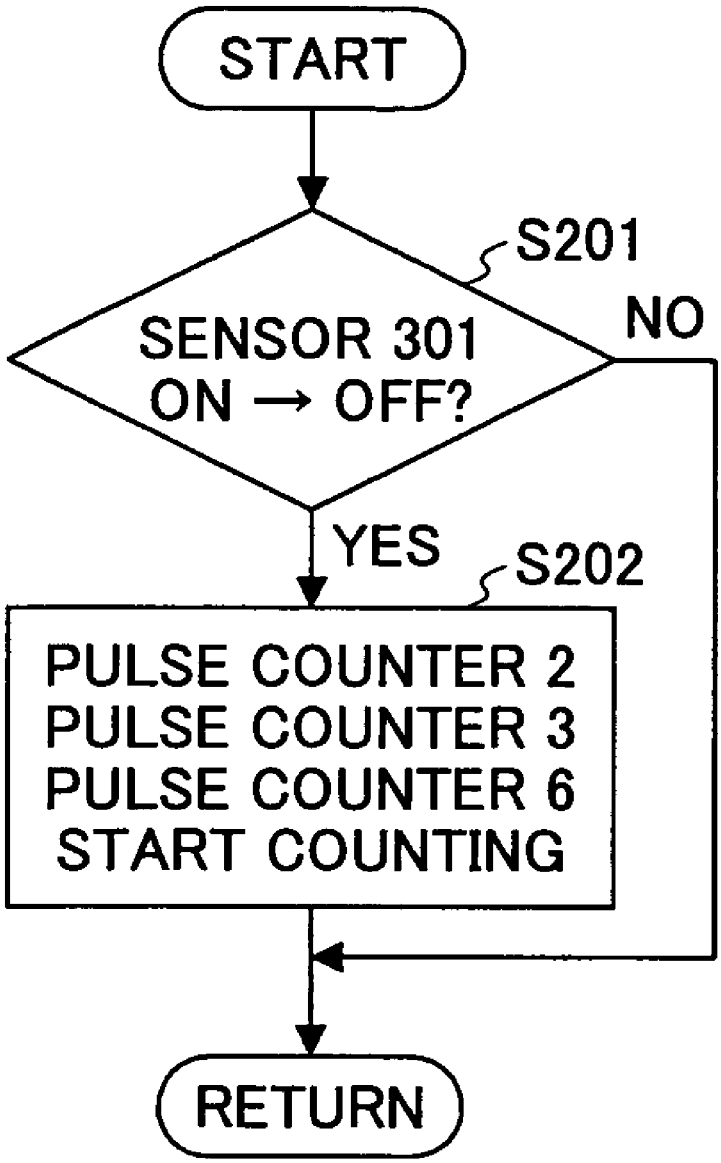
FIG. 9 is a flowchart for explaining the control of a paper back-end reference counter according to an embodiment.

In step S105, when the count value of the pulse counter 1 reaches "P1", a predetermined value unique to the model of the image forming system regardless of paper size (YES in step S105), a determination is made of whether the second transportation motor M2 is in an ON state (step S106) If the second transportation motor M2 is in the OFF state, the second transportation motor M2 is turned on, and the transportation rollers R3, R4, and R5 start transporting at a transportation speed V1 (step S107). A pulse counter 2 counts the rotation of the second transportation motor M2 (step S108). As shown in the flowchart of FIG. 9, after the detection state of the entrance sensor 301 changes from ON to OFF, that is, the back end of the paper is detected, the pulse counter 2 starts counting (step S201, S202).

In step S108, when the count value of the pulse counter 2 reaches P2, the first transportation motor M2 is accelerated (|V2|>|V1|) in step S109. A determination is made of whether the accelerated paper needs to be set aside in the pre-stacking path E (step S110). Whether the accelerated paper needs to be set aside is determined based on information sent from the image forming apparatus PR in the previous step S101. If the accelerated paper needs to be set aside, the count value of the pulse counter 3 is compared with a predetermined count value P3 (step S111). When the count value of the pulse counter 3 reaches P3, the second transportation motor M2 is stopped (step S112), and then, is reversed (step S113). As the transportation motor M2 reversely rotates, the transporting rollers R3, R4, and R5 reversely rotate at a higher speed V3 than the initial transportation speed V1 (|V3|>|V1|). Then, the number of pulses since the transportation motor M2 starts reversely rotating is counted by a pulse counter 4 (step S114). The count value of the pulse counter 4 and the switchback pulse P4 determined in step S101 are compared. When the count value of the pulse counter 4 reaches the switchback pulse P4 (YES in step S114), the transportation motor M2 is stopped (step S115). Steps S101 through S115 correspond to the operation shown in FIG. 4 and 5.

On the other hand, if a determination is made that the accelerated paper does not need to be set aside in step S110, a determination is made of whether there is a next sheet of paper in step S116. If there is the next sheet of paper, when the count value of the pulse counter 5 reaches a predetermined count value P5 (YES in step S117), the second transportation motor M2 is decelerated (in step S118). The next sheet of paper is superposed on the paper set aside in the pre-stacking path E, and is discharged to the staple processing tray F.

If there is not another sheet of paper in step S116, when the count value reaches a predetermined count value P6 (YES in step S119), the second transportation motor M2 is stopped (step S120). The predetermined count value P6 is the count value between the back end of the paper passing through the entrance sensor 301 and the paper being discharged in the staple processing tray F.

Two counters, that is, the first counter for counting driving pulses of the first transport motor M1 and the second counter for counting driving pulses of the second transport motor M2, are enough. The first counter functions as the pulse counters 1, 2, 3, 5, 6 described above, and the second counter functions as the pulse counter 4 described above. The pulse counters 2, 3, and 6 are configured to use the detection by the entrance sensor 301 of the back end of the paper as a reference (FIG. 9). The pulse counters 1 and 5 are configured to use the detection by the entrance sensor 301 of the front end of the paper as a reference (FIG. 10).

Figure 10:
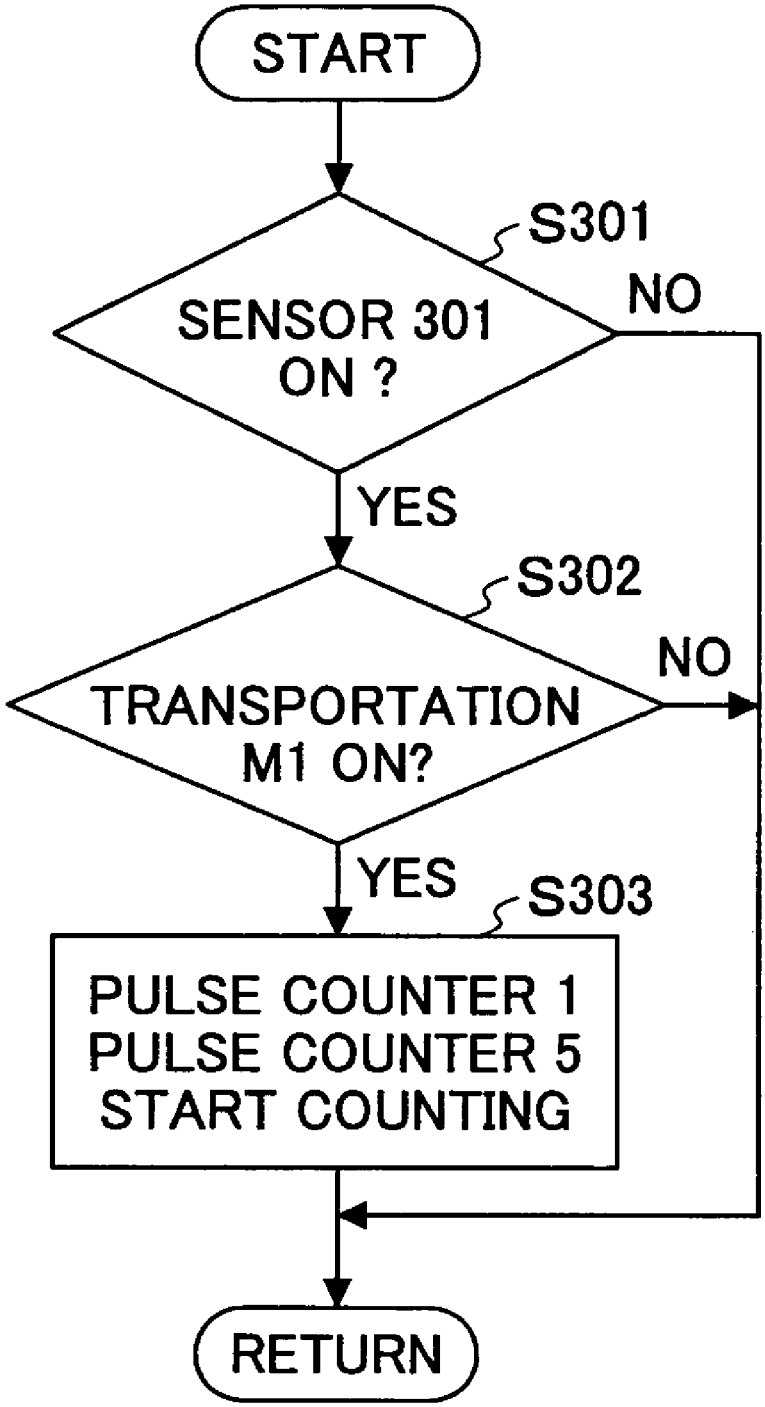
FIG. 10 is a flowchart for explaining the control of a paper front-end reference counter according to an embodiment.
Figure 11:
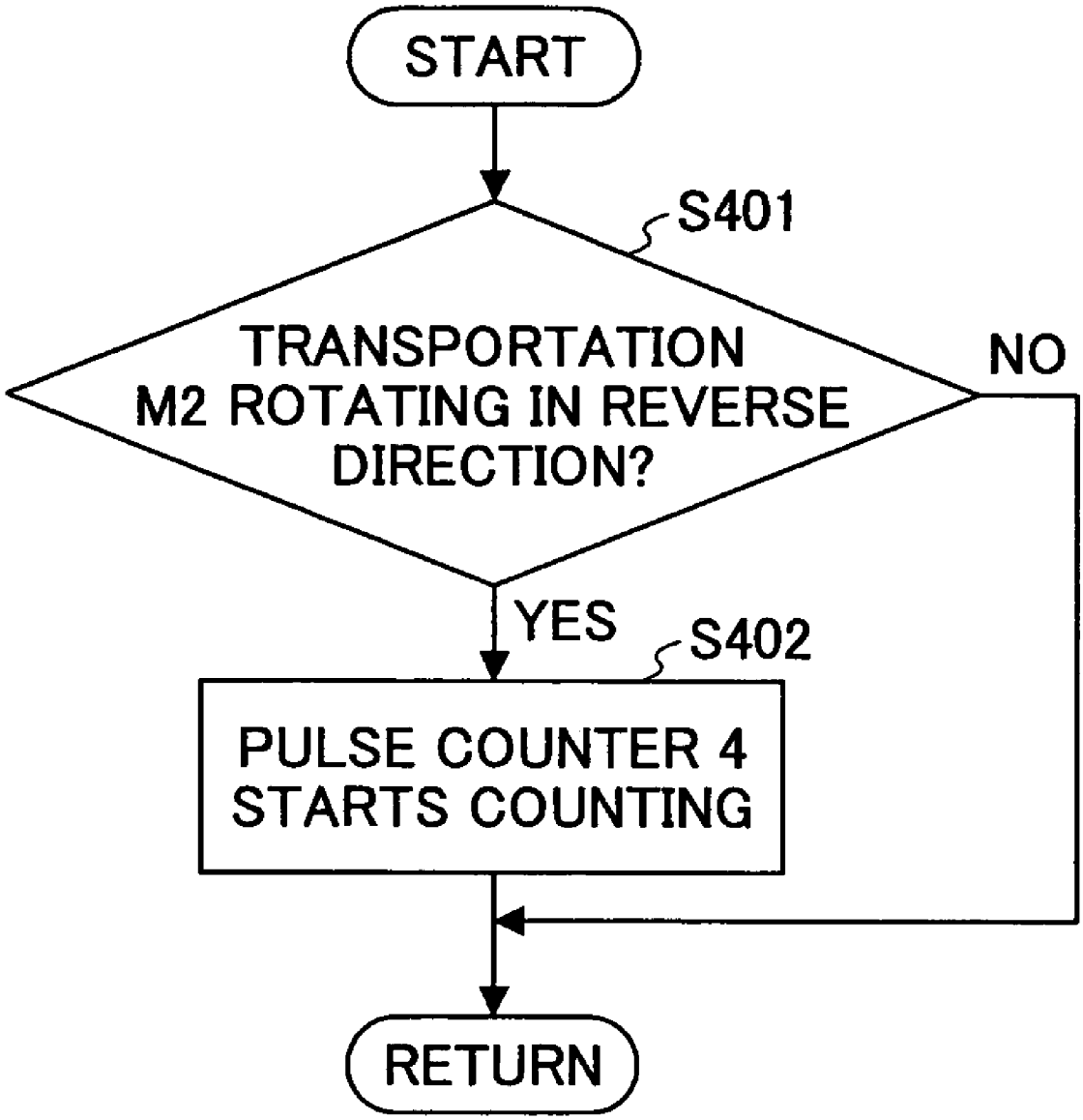
FIG. 11 is a flowchart for explaining the control of a reversing distance counter according to an embodiment.

According to another embodiment, the entrance sensor 301 may be provided with the following counters: a first counter that uses the back end of the paper as a reference (back-end reference counter in FIG. 9), a second counter that uses the front end of the paper as a reference (front-end reference counter in FIG. 10), and a third counter for counting the reverse rotation of the second transportation roller M2 when the paper is set aside (reverse distance counter in FIG. 11). In this case, the first counter may function as the pulse counters 2, 3, and 6, the second counter may function s the pulse counters 1 and 5, and the third counter may function as the pulse counter 4.

According to yet another embodiment, respective six pulse counters 1-6 may be provided, and be controlled as shown in FIGS. 9 through 11.

The pulse count values P1, P2, P3, P5, and P6 are predetermined depending on the model of the paper handling apparatus PD regardless of paper size. The pulse count value P4 is predetermined depending on paper size. However, the pulse count value P4 can be changed based on input data and paper information from an operations panel of the image forming apparatus PR, for example.

As shown in the flowchart of FIG. 10, if the entrance sensor 301 detects the front end of the paper (step S301) and the first transportation motor M1 is being activated (step S302), the pulse counters 1 and 5 of steps S105 and S117 start counting the motor pulse of the first transportation motor M1. (step S303). As shown in the flowchart of FIG. 9, when the entrance sensor 301 is turned OFF from ON, that is, when the back end of the paper is detected (step S201), the pulse counters 2, 3, and 6 of steps S108, S111, and S119 start counting the motor pulse of the first transportation motor (step S202). As shown in the flowchart of FIG. 11, when the second transportation motor M2 starts reversely rotating, the pulse counter 4 of step S114 starts counting the motor pulses of the second transportation motor M2.

In FIGS. 8 through 11, the first and second transportation motors M1 and M2 are controlled using the driving pulses as control parameters. According to another embodiment, time can be used as a control parameter.

As described above, a paper handling apparatus according to the embodiment determines timing in which the paper set aside is transported and timing the paper is reversely transported using the paper detection unit provided at the entrance of the paper handling apparatus PD. The above timing can be easily adjusted based on the thickness of the paper, the curl of the paper, and the number of set-aside sheets of paper. The paper handling apparatus can handle a batch of paper at high quality. Since the paper detection unit and the shape of the guide plate can be made simple, the cost of the paper handling apparatus can be reduced.

$2^{nd}$ Embodiment

Figure 12:
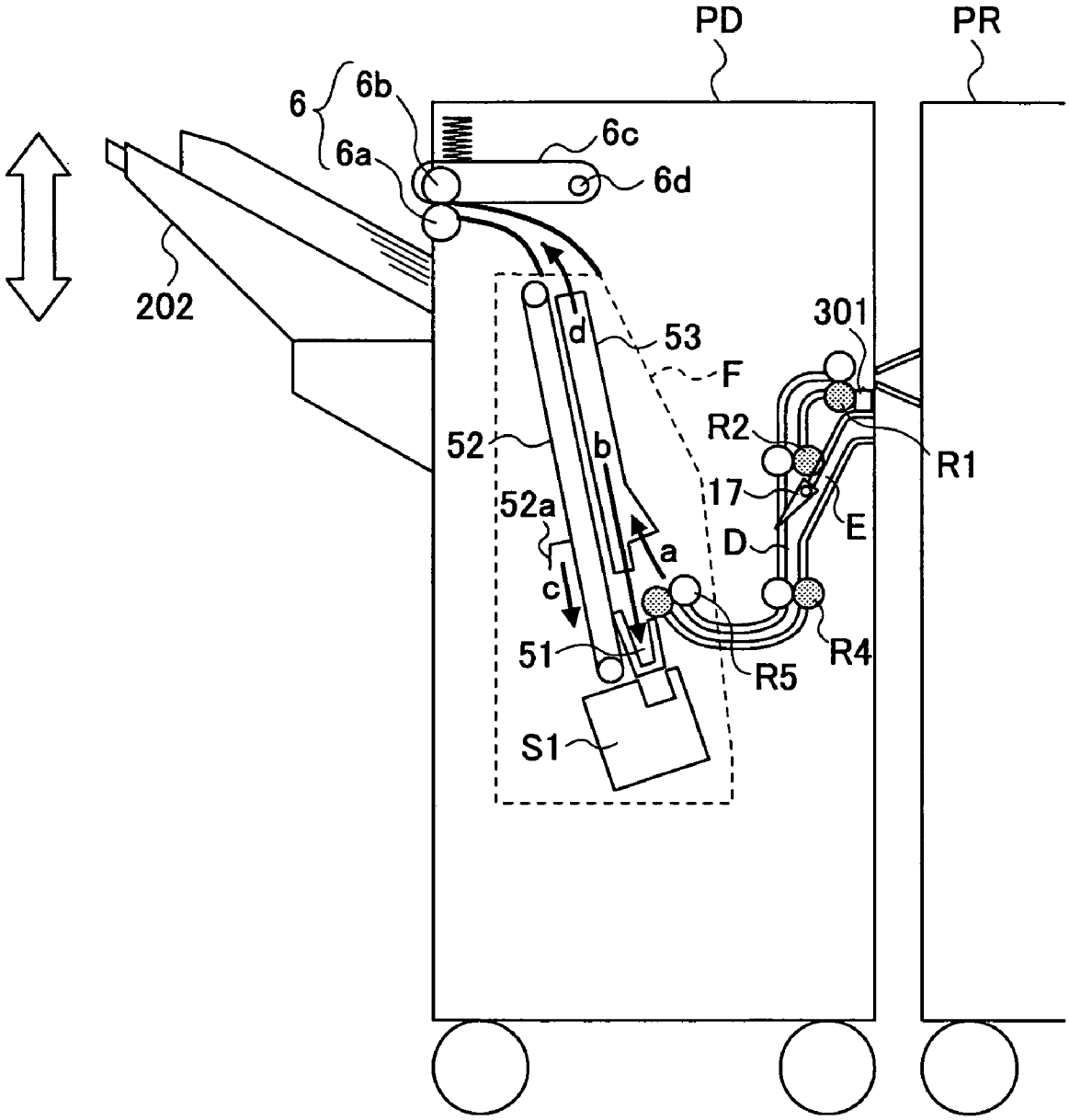
FIG. 12 is schematic diagram for explaining a paper handling apparatus according to another embodiment.

FIG. 12 is a schematic diagram for explaining the operation of a paper handling apparatus according to the second embodiment of the present invention. FIGS. 13 through 16 are schematic diagrams for explaining the pre-stacking operation of the paper handling apparatus according to the second embodiment in which the paper is set aside in the pre-stacking path E and re-transported. Elements identical to those of the paper handling apparatus according to the first embodiment are referred to by the same reference symbols, and their description is omitted.

As shown in FIG. 12, the paper handling apparatus PD according to the present embodiment is different from that of the first embodiment shown in FIG. 3 in that the transportation roller R3 is removed and the transportation roller R4 functions as the transportation rollers R3 and R4 of the first embodiment.

If the transportation roller R3 is removed, the paper cannot be reversely transported to a position as distant from the transportation roller 4 as the paper is in the first embodiment. This problem is caused by the fact that, when the paper moves out of the nip of the transportation roller 4, the transportation roller 4 cannot apply transportation force to the paper. In addition, if the back end of the paper becomes lower than the front end of the paper as it is in the first embodiment, the paper cannot return to the transportation roller 4 due to the gravity. Accordingly, in the second embodiment, the pre-stacking path E is formed in such a manner that it slantly extends to the right upper direction from the swing edge of the branching nail 17 as shown in FIG. 12. As a result, the front end of the paper set aside in the pre-stacking path E does not separate from the transportation roller R4. The other elements are configured in the same manner as those of the paper handling apparatus PD shown in FIG. 3.

The paper handling apparatus PD according to the second embodiment can set aside a sheet of paper output from the image forming apparatus PR in the pre-stacking path E, and transport the set-aside sheet of paper superposing it with a next sheet of paper output from the image forming apparatus PR to the staple processing tray F. The operation is described below with reference to FIG. 13. The sheet of paper P1 is transported by the transportation rollers R1 and R2 rotating forward. The front end of the sheet P1 pushes the back face of the branching nail 17 and proceeds to the downstream direction in the path D. When the pulse number reaches the predetermined number P4 after the entrance sensor 301 detects the back end of the sheet P1, the transportation rollers R4 and R5 rotate in the reverse direction as shown in FIG. 14. The sheet P1 is transported in the opposite direction. The branching nail 17 closes the path D side, and opens the pre-stacking path E side. According to such arrangement, the back end of the sheet P1 is directed into the pre-stacking path E by the branching nail 17. When the front end of the sheet P1 exits the nip of the transportation roller R4, the sheet P1 stops. The sheet P1 is in a set-aside state. The transportation rollers R4 and R5 stop.

Figure 15:
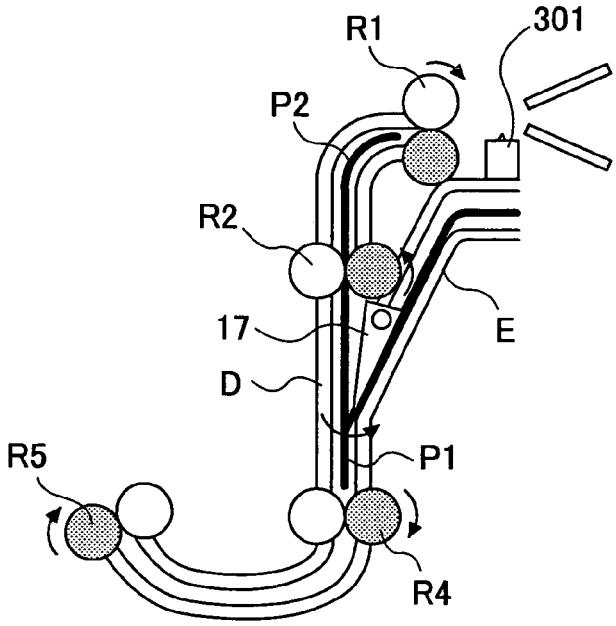
FIG. 15 is yet another schematic diagram for explaining the operation of the paper handling apparatus according to an embodiment, in which a following sheet of paper has been transported to the path D.

While the sheet P1 is in the set-aside state, a following sheet P2 is output from the image forming apparatus PR, and is transported by the transportation rollers R1 and R2 rotating in the forward direction. When the front end of the following sheet P2 comes to the position of the front end of the preceding sheet P1, and both sheets P1 and P2 superpose as shown in FIG. 15, the transportation rollers R4 and R5 start rotating in the forward direction. If only two sheets P1 and P2 need to be transported together, the two superposing sheets P1 and P2 are discharged in the staple processing tray F.

Figure 13:
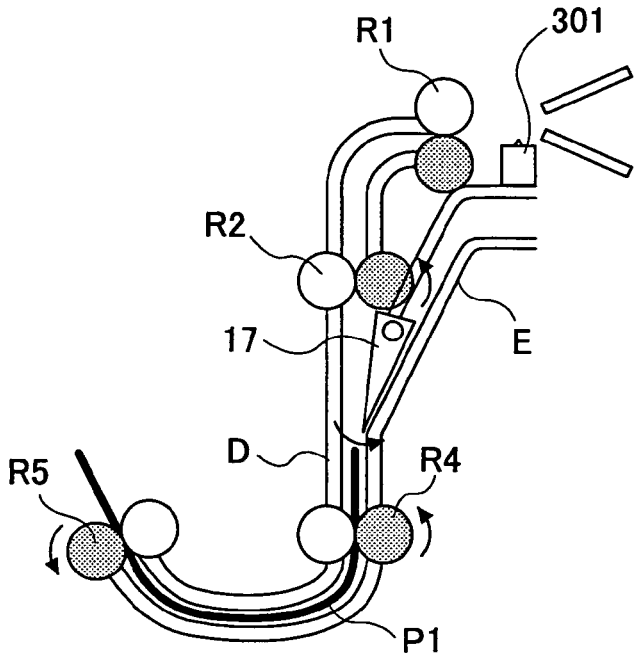
FIG. 13 is an enlarged schematic diagram for explaining the operation of the paper handling apparatus according to an embodiment, in which a preceding sheet of paper has been transported to the path D.
Figure 14:
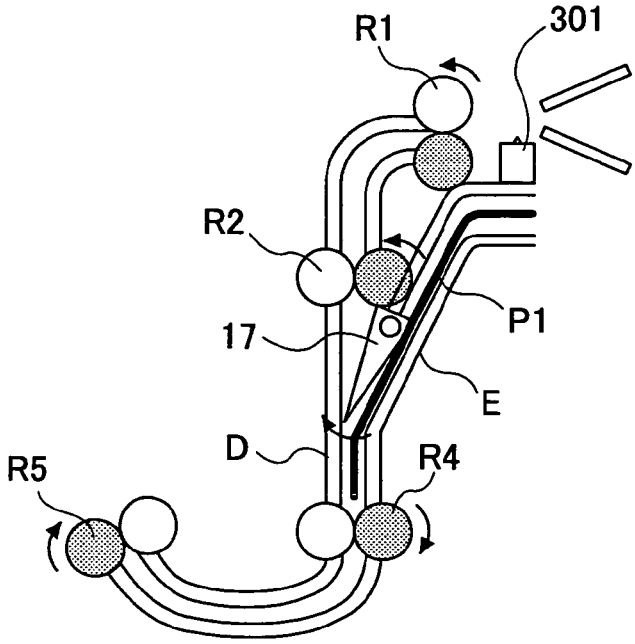
FIG. 14 is another enlarged schematic diagram for explaining the operation of the paper handling apparatus according to an embodiment, in which the preceding sheet of paper is reversely transported and stored in a pre-stacking path.

If more sheets of paper need to be superposed and transported together, the transportation rollers R4 and R5 are rotated in the reverse direction at the same timing as shown in FIG. 13. The two superposed sheets P1 and P2 are transported to the pre-stacking path E, and stop. When a third sheet comes to the position in which the third sheet superposes the two superposing sheets P1 and P2, the three sheets of paper are sent to the staple processing tray F.

The other portions that have not been described explicitly are configured in the same manner as the first embodiment. The paper handling apparatus according to the second embodiment operates in the same manner as the first embodiment does as described with reference to the flowcharts shown in FIGS. 8 through 11.

3rd Embodiment

In the case of the second embodiment, when the sheet P1 is in the set-aside state, the sheet P1 is not nipped by the transportation roller R4. While the sheet P1 is in the set-aside state, the sheet P1 may remain nipped by the transportation roller R4 in the third embodiment.

Figure 16:
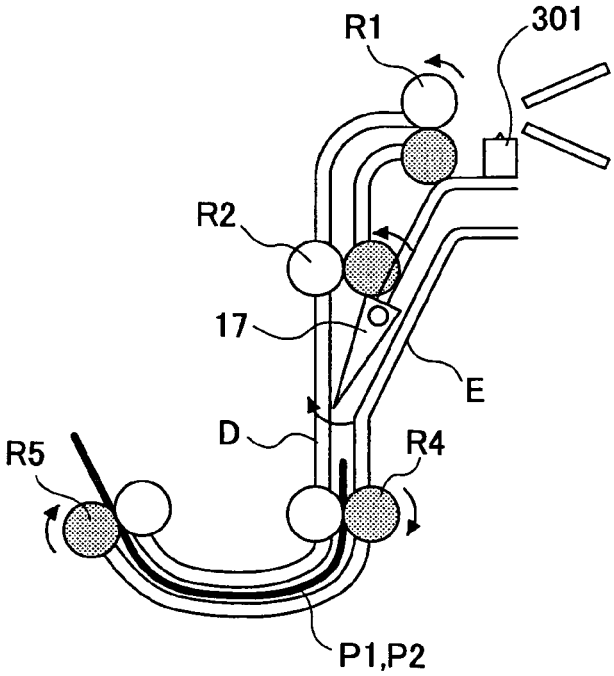
FIG. 16 is yet another schematic diagram for explaining the operation of the paper handling apparatus according to an embodiment, in which the following sheet of paper is stacked with the preceding sheet of paper, and the batch of paper is output from the pre-stacking path.

In the set-aside state, the sheet P1 is nipped by the transportation roller R4 with its front end protruding from the transportation roller R4 to the downstream direction. When the following sheet P2 comes to the nip of the transportation roller R4, the two sheets P1 and P2 are transported together as shown in FIGS. 15 and 16. The front end of the preceding sheet P1 is ahead of the front end of the following sheet P2 by a predetermined distance. In the case of the second embodiment, the sheet P1 is positioned at the nip of the transportation roller R4 by gravity. It would be possible for the set-aside paper to accidentally fail to be nipped again by the transportation roller R4. According to the third embodiment, since the paper is nipped by the transportation roller R4, such failure in transportation cannot occur.

The third embodiment has been described in which a preceding sheet P1 and a following sheet P2 are superposed, and are transported together. If a third sheet needs to be superposed and transported together, the sheets P1 and P2 are nipped by the transportation roller 4 even in the set-aside state.

The paper handling apparatus according to the third embodiment operates in the same manner as shown in the flowcharts of FIGS. 8 through 11. The operation according to the third embodiment is different from that of the second embodiment in that an amount (pulse counts) for which the second transportation motor M2 rotates in the reverse direction in step S114 is different. According to the second embodiment, when set aside, the paper leaves the nip of the transportation roller R4 toward the upstream direction. The second transportation motor M2 needs to rotate for an amount (motor pulses) great enough to have the paper leave the nip of the transportation roller R4. However, according to the third embodiment, since the paper remains nipped by the transportation roller R4, the amount for which the second transportation motor M2 needs to rotate is smaller.

Other portions that have not been explicitly explained are configured in the same manner as those of the first and second embodiments.

According to the first through third embodiments, timing in which the paper is transported or reversely transported is determined based on the output of the entrance sensor 301 (paper detection unit) provided at the input unit of the paper handling apparatus PD. It is easy to adjust the control of the paper handling apparatus based on various changes in state such as the thickness of the paper, the curl of the paper, and the number of set-aside sheets of paper. A high quality paper handling apparatus can be provided. The paper detection unit and the shape of the guide plates can be made simpler, and as a result, the cost of the paper handling apparatus can be reduced.

As described above, according to the above embodiments of the present invention, the paper detection unit (the entrance sensor 301 in the illustrated embodiment) is provided at a more upstream position than the branching nail 17 that guides the paper to the pre-stacking path E. Timing in which the set-aside paper is transported from the pre-stacking path E is determined based on the detection of the front end of the following sheet of paper. Additionally, timing in which the paper is reversely transported to the pre-stacking path E is determined based on the detection of the back end of the sheet of paper. The pre-stacking operation does not require additional paper detection units. As a result, the cost of the paper handling apparatus can be reduced, since those timings can be adjusted based on the state of the paper.

The above embodiments can be applied to various applications since they are applicable to cases in which more than two sheets of paper are superposed.

Since the timing in which the paper is transported out of the pre-stacking path E and the timing in which the set-aside paper is transported again can be adjusted based on the state of the paper, the paper detection unit and the shape of the guide plate can be made simple, and as a result, the cost of the paper handling apparatus can be reduced.

Since the timing in which the paper is transported out of the pre-stacking path E and the timing in which the set-aside paper is transported again can be adjusted based on the number of sheets of paper set aside in the pre-stacking path E, the paper detection unit and the shape of the guide plate can be made simple, and as a result, the cost of the paper handling apparatus can be reduced.

The processing tray corresponds to the staple processing tray F. The first and second paths correspond to the path D and the pre-stacking path E, respectively. The transportation unit corresponds to the transportation rollers 2, 7, 8, 9, 10, 11 (R1, R2, R3, R4, and R5), and the first and second transportation motors M1 and M2. The branching unit corresponds to the branching nail 17. The paper detection unit corresponds to the entrance sensor 301. The control unit corresponds to the CPU 360. The first and second transportation roller pairs correspond to the transportation rollers 8 (R3) and 9 (R4), respectively. The paper handling apparatus corresponds to the paper handling apparatus PD, and the image forming apparatus corresponds to the image forming apparatus PR.

The preferred embodiments of the present invention are described above. The present invention is not limited to these embodiments, but variations and modifications may be made without departing from the scope of the present invention.

This patent application is based on Japanese Priority Patent Applications No. 2003-202411 filed on Jul. 28, 2003, and No. 2004-142129 filed on May 12, 2004, the entire contents of which are hereby incorporated by reference.

What is claimed is:

1. A paper handling apparatus, comprising:

a first path that guides paper to a processing tray;

a second path in which the paper is set aside, said second path branching from said first path;

a transportation unit that transports the paper in one of a first direction toward the processing tray and a second direction opposite to the first direction;

a branching unit that, when the paper is transported in the second direction, leads the paper to the second path;

a single paper detection unit provided at a position upstream of the branching unit; and a control unit that determines timing in which the paper is transported in the second direction based on an output of the paper detection unit, and causes the transportation unit to transport the paper to the second path;

wherein the paper handling apparatus sets aside a preceding sheet of the paper in the second path by reversing the preceding sheet with the attitude thereof kept unchanged, and transports the set-aside preceding sheet of the paper with a following sheet of the paper, the control unit determines timing in which the paper is transported in the second direction based on timing in which the single paper detection unit detects a back end of the preceding sheet and wherein the control unit determines timing in which the preceding sheet and the following sheet are superposed and transported together toward the processing tray based on timing in which the front end of the following sheet is detected.

2. The paper handling apparatus as claimed in claim 1, wherein the transportation unit further comprises:

a first transportation roller pair rotatable in a first rotative direction and in a second rotative direction, the first transportation roller pair provided in the second path; and a second transportation roller pair that can rotate in the first rotative direction and in the second rotative direction, the second transportation roller pair provided at the processing tray side of the branching unit;

wherein when the paper is transported in the second direction, the control unit causes the first transportation roller pair to transport the paper in a manner in which the first transportation roller pair transports the preceding sheet so that the preceding sheet moves away from the second transportation roller pair.

3. The paper handling apparatus as claimed in claim 2, wherein when the following sheet passes the preceding sheet by a predetermined distance, the control unit causes the first and second transportation roller pairs to rotate in the first rotative direction so that the preceding sheet and the following sheet are transported to the processing tray, the preceding sheet and the following sheet superposing.

4. The paper handling apparatus as claimed in claim 1, wherein the transportation unit further comprises:

a second transportation roller pair that can rotate in a first rotative direction and in a second rotative direction, the second transportation roller pair provided at the processing tray side of the branching unit;

wherein the control unit causes the second transportation roller pair to rotate in the second rotative direction so that the preceding sheet of the paper is led to the second path, and to stop with the preceding sheet being nipped by the second transportation roller pair.

5. The paper handling apparatus as claimed in claim 4, wherein when the second transportation roller pair stops, the preceding sheet remains nipped by the second transportation roller pair with the front end portion of a predetermined length thereof being left at the processing tray side.

6. The paper handling apparatus as claimed in claim 5, wherein when the following sheet arrives at the nip of the second transportation roller pair, the control unit causes the second transportation roller pair to rotate in the first rotative direction so that the preceding sheet and the following sheet are superposed, the preceding sheet being ahead by a predetermined length, and are transported toward the processing tray.

7. The paper handling apparatus as claimed in claim 1, wherein the transportation unit further comprises:

a second transportation roller pair that can rotate in a first rotative direction and in a second rotative direction, the second transportation roller pair provided at the processing tray side of the branching unit;

wherein the control unit causes the second transportation roller pair to rotate in the second rotative direction so that the preceding sheet of the paper is led to the second path, and to stop with the preceding sheet discharged from the nip of the second transportation roller pair.

8. The paper handling apparatus as claimed in claim 7, wherein when the following sheet arrives at the nip of the second transportation roller pair, the control unit causes the second transportation roller pair to rotate in the first rotative direction so that the preceding sheet and the following sheet are superposed and transported together toward the processing tray.

9. The paper handling apparatus as claimed in claim 1, wherein the timing in which the paper is transported in the second direction is adjustable based on at least one of a signal from an image forming apparatus to which the paper handling apparatus is connected, the thickness of the paper transported from the image forming apparatus, and the number of sheets of paper set aside in the second path.

10. The paper handling apparatus as claimed in claim 1, wherein the timing in which the preceding sheet and the following sheet are superposed and transported together toward the processing tray is adjustable based on at least one of a signal from an image forming apparatus to which the paper handling apparatus is connected, the thickness of the paper transported from the image forming apparatus, and the number of sheets of paper set aside in the second path.

11. The paper handling apparatus as claimed in claim 1, wherein at least two sheets of paper are transported to the processing tray via the first and second paths.

12. An image forming system, comprising:

an image forming apparatus; and the paper handling apparatus as claimed in claim 1, the paper handling apparatus processing the paper output by the image forming apparatus.

* * * * *